United States Patent [19]

Anderson

[11] 4,133,123

[45] Jan. 9, 1979

[54] UTILITY BULLETIN BOARD

[76] Inventor: Sandra Anderson, P.O. Box 345, Perryville, Md. 21903

[21] Appl. No.: 737,774

[22] Filed: Nov. 1, 1976

[51] Int. Cl.[2] ..... G09F 11/00

[52] U.S. Cl. ..... 40/1; 40/124; 40/611

[58] Field of Search ..... 40/125 F, 63, 107, 1, 40/124

[56] References Cited

U.S. PATENT DOCUMENTS

| | | | |
|---|---|---|---|
| 373,235 | 11/1887 | Isbell | 40/107 |
| 1,494,583 | 5/1924 | Brooks | 40/125 F |
| 2,195,985 | 4/1940 | Fox | 40/125 F |
| 2,743,011 | 4/1956 | Woofter | 40/107 X |
| 2,965,978 | 12/1960 | Olson | 35/23 |

*Primary Examiner*—Russell R. Kinsey
*Assistant Examiner*—Wenceslao J. Contreras
*Attorney, Agent, or Firm*—Morton J. Rosenberg

[57] ABSTRACT

A work control center system which incorporates a planar member formed of a porous resilient material adapted for mounting of sheet material through insert of tack members. The planar member includes classification elements where the materials being mounted may be classified into distinct topic areas. Additionally, the work control center system has a plurality of receptacles which are structurally adapted to contain various utensils, work material and monies. One of the receptacles is generally cup shaped in contour and is specifically adapted for insert of the hand of a user in order that small elements such as coins may be easily inserted and retracted. The work control center system further includes hook members mounted on a lower surface thereof for mounting of other types of sheet materials such as calendars.

7 Claims, 5 Drawing Figures

UTILITY BULLETIN BOARD

BACKGROUND OF THE INVENTION

1. Field of the Invention

This invention pertains to work control center systems where materials may be mounted and classified into particular topic areas. This invention relates to bulletin board type systems which provide for block elements mounted to the bulletin board for classification of materials mounted under each of the block elements. In particular, this invention relates to bulletin board type systems which include a plurality of receptacles mounted on the board member. Still further, this invention relates to receptacles having different contours so that they can easily be identified for insert and retraction of particular elements or utensils associated with each of the receptacles. More in particular this invention relates to bulletin board type systems having a cup shaped receptacle mounted thereto for insert and retraction of small elements such as coins. Additionally, this invention pertains to bulletin board type systems having open contour box like receptacles mounted to the face of the bulletin board for reception of various work materials. More in particular, this invention pertains to bulletin board type systems having additional hook elements mounted to a lower surface of the bulletin boards in order to mount various sheet material thereto.

2. Prior Art

Bulletin board type systems are well known in the art. However, previous types of bulletin board systems do not provide for a central control center where numerous types of material may be mounted thereto. In some prior art bulletin boards, there are no classification blocks where a particular topic materials may be mounted in particular location areas. Thus, there is a possiblity of different topic areas being intermixed and not providing the appropriate information necessary.

In other types of bulletin boards, there are no receptacles which allow for the insert of various types of materials. Thus, such bulletin boards do not provide for a total work control center system where various implements may be inserted and maintained in a proper location. Additionally, some prior bulletin board systems do not provide differently contoured receptacles for insert of different implements and other elements.

SUMMARY OF THE INVENTION

A work control center system for maintaining materials in a central location which includes a planar member adapted for releasable mounting of the materials thereto. The control center system has a storage mechanism secured to the frontal wall of the planar member which is adapted for removeable insert of the materials. Further, the work control center system includes an insert mechanism secured to the frontal wall of the planar member and has a contour distinct from the storage mechanism.

An object of the work control center system is to encourage student motivation and organization.

Another object of the work control center system is to provide a user with a central loation to place specific materials.

In particular, another object of this invention is to provide a child with a predetermined location to place things of importance to him or her.

A still further object of this invention is to provide a bulletin board type of work control center which allows classification of particular topic areas.

Another object of this invention is to provide a plurality of receptacles mounted to the planar member of the work control center system for insert of particular elements.

Another object of this invention is to provide at least one cup shaped receptacle mounted to a planar member of the work control center system for insert and retraction of coin type elements.

DESCRIPTION OF THE PREFERRED EMBODIMENTS

Figure 2:
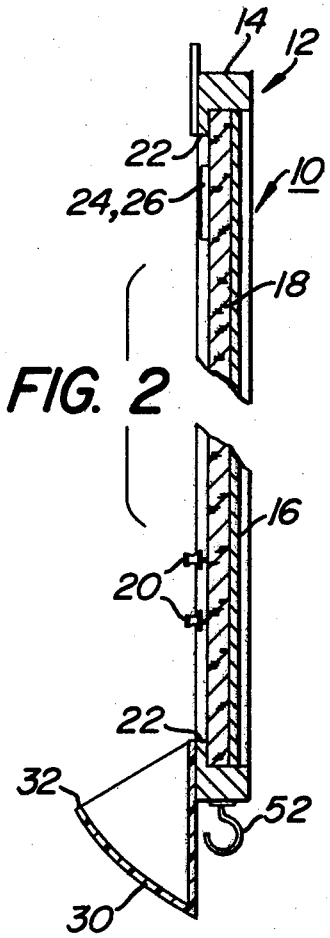
FIG. 2 is a cut away sectional view of the work control center system taken along the section line 2—2 of FIG. 1.
Figure 1:
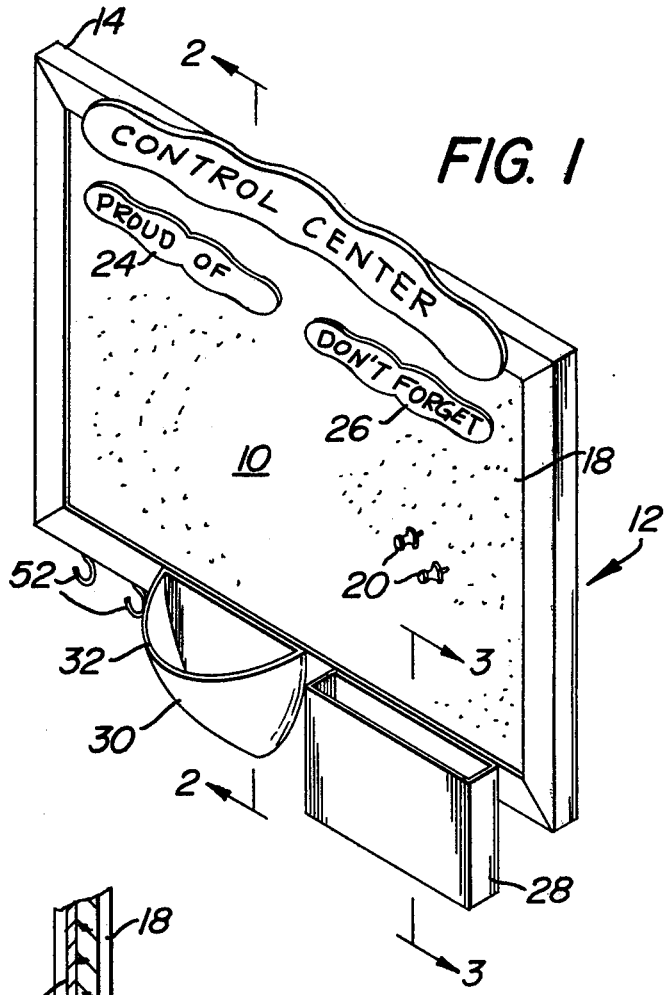
FIG. 1 is a perspective view of the work control center system.
Figure 3:
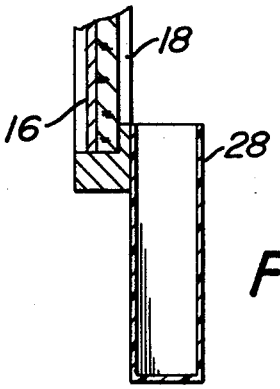
FIG. 3 is a partial cut away of a sectional view of a receptacle mounted to a planar member of the work control center system taken along the section lines 3—3 of FIG. 1.

Referring now to FIGS. 1 and 2 there is shown work control center system 10 for maintaining and classifying materials in a central location. In overall concept, control center system 10 provides for an accessible, and highly visible area where materials may be mounted, stored and classified as well as otherwise maintained devoid of the possibility of loss. In particular, and as will be described in following paragraphs, system 10 is particularly adaptable for use by children to permit the child to mount materials of importance to him or her. Additionally, system 10 provides locations whereby a parent or guardian may insert or mount materials for which the child must retain responsibility. System 10 further includes a plurality of receptacles which may be utilized to hold implements of importance to the child's school work or other activities as well as to provide a predetermined contour type receptacle where monies may be maintained for future use. Although as has been stated, system 10 is particularly adaptable for use by children in the home, such is not limited to uses of this nature but may be adapted as an overall work control center system.

Work control center system 10 includes planar member 12 adapted for releasable mounting of materials such as paper sheets and the like thereto. Planar member 12 may be formed in rectangular contour as is shown in FIG. 1 and may have a closed contour frame member 14 defining the periphery thereof. Rear wall 16, shown in FIG. 2 is mounted within frame member 14 and provides a backing for resilient material layer 18. Both of frame member 14 and rear wall 16 may be formed of a wood like material not important to the inventive concept as is herein defined with the exception that such material be able to accept any dynamic and static force bads applied to control center system 10 during the normal course of operation.

Additionally, rear wall 16 may be secured to frame member 14 through adhesive bonding, screws, nailing or some like technique.

Resilient material layer 18 is generally porous in nature and is adapted for insert of tack elements 20 for mounting of sheet material to planar member 12 in a releasable manner. Resilient material layer 18 may be formed of cork board or some like material which permits insert and removal of tack members 20. Porous material layer 18 may be secured to rear wall 16 in a fixed manner such as through adhesion, nailing or some like manner. Additionally, material layer 18 may otherwise be fixedly mounted within frame member 14 through lug like extensions 22 which form part of frame member 14. As can be seen, material layer 18 may be maintained from removal of frame 14 and rear wall 16 by insert into the partial cavity formed by the extensions 22 which block the path of removal of material layer 18 from frame 14 and rear wall 16.

Work control center system 10 includes at least a pair of block elements 24 and 26 which are secured to frontal wall or layer 18 of planar member 12 for classifying materials which are mounted to planar member 12 through tack members 20. Block elements 24 and 26 may include predetermined indicia inscribed thereon in order that materials of a particular nature may be mounted thereunder in columnar fashion. Block elements 24 and 26 may be releasably mounted to layer 18 through adhesive contact in a reversible manner such that a number of multiplicity of block elements 24, 26 may be secured to layer 18 responsive to the wishes of a user. Thus, block elements 24 and 26 may be applied to a plurality of topics. As has been stated, block members 24 and 26 may be attached to layer 18 through adhesive bonding which may be of the releasable type such as Velcro mating surfaces on the rear wall of block elements 24, 26 and the attachment surface of layer 18. Still further, block elements 24 and 26 may in themselves be of sufficient thickness to allow mounting through tack members 20.

Work control center system 10 further includes storage mechanism 28 secured to a frontal wall of planar member 12 and particularly to frame member 14 and is adapted for removeable insert of various materials. Storage mechanism 28 provides for an open contour receptacle member which is adapted for vertical reversible insert of materials or implements. As shown in FIG. 1, receptacle member 28 is generally a parallelapiped contour having an open upper wall section. This type of contour allows for insert of work cards, pencils, scissors, rulers, and other implements which may be of use in daily activities of the user. Receptacle memger 28 may be mounted to frame member 14 through adhesive bonding, nailing or some like technique not important to the inventive concept as is herein defined.

Still further, receptacle 28 may take the form of an extended pocket member which is vertically directed downward from frame member 14. In this type of receptacle 28, a flexible type material for construction may be utilized such as plastic or some like material. Additionally, in order to classify the work or other material contained within receptacle 28, appropriate indicia may be provided to aid the user.

Control center system 10 further includes insert element 30 which is secured to a frontal wall of planar member 12 or frame member 14. Insert element 30 has an overall contour distinct from storage mechanism 28 in order to provide distinction and easy classifications of particular materials contained in each of elements 28 and 30. Insert element 30 is generally cup-shaped in contour and extends from frame member 14 in an arcuate contour as defined by lip 32. Insert element 30 is generally maintained for storage of monies and includes an upper surface of sufficient area that the hand of a user may be inserted to retract or insert money easily. Thus, in overall context, insert element 30 provides for an open contour cupshaped receptacle member which is adapted for storage of monies which can easily be inserted and retracted.

Figure 4:
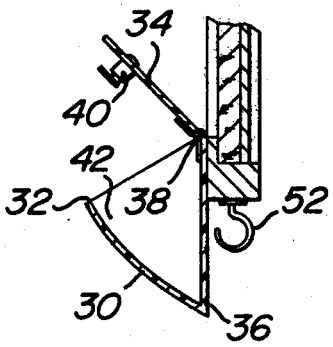
FIG. 4 is a partial cut away elevational view of a cup type receptacle of the work control center system having a lid and locking mechanism; and, FIG. 5 is a further embodiment of an insert mechanism which may be mounted to the planar member of the work control center system for releasable securement of a container.

In the embodiment shown in FIG. 4, insert element 30 may be provided with a lid covering 34. Lid 34 may be rotatably mounted to cup rear wall 36 through hinge 38 secured on opposing ends to lid cover 34 and cup rear wall 36 as shown in FIG. 4. Additionally, lid covering 34 may include a standard key operated lock 40, well known in the art for insert into latch or lug member 42 mounted on a frontal wall of insert cup element 30 as shown. In this manner, lid 34 may be closed and locked to provide a closed chamber where monies or other valuables may be maintained in a secure manner.

Figure 5:
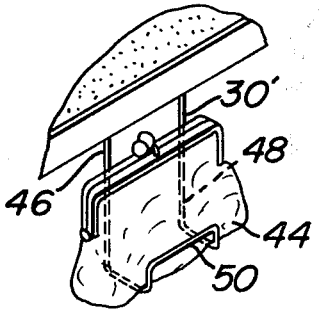

Another embodiment of the subject invention is shown in FIG. 5 where insert element 30' includes a U-shaped frame member which is adapted for releasable securement of container 44 which may be a wallet or purse like receptacle. Insert element 30' is formed of a pair of wire elements 46 and 48 which are secured to a bottom wall of frame member 14 or planar member 12 as is shown. Each of frame elements 46 and 48 are vertically directed in a downward manner from frame member 14 and pass in a substantially horizontal plane forward of planar member 12 to meet and join in one piece formation across bar member 50 as is shown. In this manner, there is a recess provided wherein container 44 may be inserted and may be further retracted when desired by the user.

As shown in FIGS. 1, 2 and 4, a plurality of hook elements 52 may be secured to a bottom wall of the frame member 14 for the purpose of hanging or otherwise releasably securing various materials such as calendars and like elements to control center system 10.

While work control center system 10 has herein been shown to be applicable to specific uses as herein described, it will be obvious to those skilled in the art that system 10 may be employed in uses other than those specifically disclosed herein and that various changes and modifications other than those indicated and described above may be made in the invention without departing from the spirit and scope thereof. Thus, the invention is to only be restricted as to the appended claims as are hereinafter.

What is claimed is:

1. A work control center system for maintaining materials in a central location, comprising:

(a) a planar member adapted for releasable mounting of said materials thereto;

(b) storage means secured to a frontal wall of said planar member adapted for removable insert of said materials; and, (c) insert means secured to said frontal wall of said planar member, said insert means having a contour distinct from said storage means, said insert means being cup-shaped in contour extending frontally from said frontal wall in an arcuate contour, said insert means adapted for inert of a hand of a user, said insert means further including locking means mounted to an upper wall member of said cup shaped insert means.

2. The work control center system as recited in claim 1 where said planar member is formed of a porous resilient material adapted for insert of tack elements for mounting of said material to said planar member in a releaseable manner.

3. The work control center system as recited in claim 2 where said porous resilient material is corkboard.

4. The work control system as recited in claim 2 including at least a pair of block elements secured to said frontal wall of said planar member for classifying said materials mounted to said planar member.

5. The work control center system as recited in claim 1 where said storage means includes an open contour receptacle member adapted for vertical reversible insert of said materials.

6. The work control center system as recited in claim 5 where said receptacle member includes a parallelapiped contour having an open upper wall.

7. The work control center system as recited in claim 1 where said insert means includes a U-shaped frame member secured to a lower wall of said planar member adapted for releaseable securement of a container.

* * * * *